US010463129B2

(12) United States Patent
Skinner

(10) Patent No.: US 10,463,129 B2
(45) Date of Patent: Nov. 5, 2019

(54) AUXILIARY HANDLE AND METHOD

(71) Applicant: Charles Skinner, Anthony, KS (US)

(72) Inventor: Charles Skinner, Anthony, KS (US)

(73) Assignee: 6445 Investments, LLC, Madison, MO (US)

( * ) Notice: Subject to any disclaimer, the term of this patent is extended or adjusted under 35 U.S.C. 154(b) by 0 days.

(21) Appl. No.: 16/121,589

(22) Filed: Sep. 4, 2018

(65) Prior Publication Data

US 2019/0142127 A1 May 16, 2019

Related U.S. Application Data

(60) Provisional application No. 62/586,820, filed on Nov. 15, 2017.

(51) Int. Cl.

| | |
|---|---|
| ***A45C 13/22*** | (2006.01) |
| ***A45C 13/26*** | (2006.01) |
| ***A45F 5/10*** | (2006.01) |
| ***A45C 13/00*** | (2006.01) |

(52) U.S. Cl.

CPC ..... *A45C 13/262* (2013.01); *A45C 13/001* (2013.01); *A45F 5/10* (2013.01); *A45C 2013/265* (2013.01); *A45F 2005/1013* (2013.01)

(58) Field of Classification Search

CPC ..... A45C 13/001; A45C 13/262; A45C 2013/265; A45F 2005/1013; A45F 2005/1006; A45F 5/10; Y10T 16/4713; Y10T 16/4559; Y10T 16/469

See application file for complete search history.

(56) References Cited

U.S. PATENT DOCUMENTS

| | | | | |
|---|---|---|---|---|
| 4,791,702 | A | 12/1988 | McVey | |
| 5,722,118 | A | 3/1998 | Hansen | |
| 5,878,853 | A | 3/1999 | DeRouen | |
| 6,317,924 | B1 | 11/2001 | Gallagher | |
| 6,360,402 | B1 * | 3/2002 | Crabtree | A45C 13/00 16/422 |
| 6,470,533 | B1 | 10/2002 | Comstock | |
| 6,578,231 | B1 | 6/2003 | Godshaw et al. | |
| 6,581,246 | B1 * | 6/2003 | Polette | A01D 34/90 16/426 |
| 6,865,777 | B2 * | 3/2005 | Comstock | A45C 13/262 16/114.1 |

(Continued)

*Primary Examiner* — Chuck Y Mah

(74) *Attorney, Agent, or Firm* — Integrity Patent Group, PLC; Charles Runyan

(57) ABSTRACT

A handle is disclosed. The handle comprises a handgrip, having a top portion, a bottom portion and, opposing side portions joined to form a structure having an opening. A ball joint connected in series to the bottom portion and including a spheroid member nested in a socket member. A hinge joint connected in series to the ball joint and the bottom portion. The hinge joint including a connection axis having a first armature and a second armature. The first armature and the second armature are configured to pivot about the connection axis. A handle mate connected in series to the bottom portion, the ball joint, and the hinge joint. The handle mate comprising an arc configured to partially circumscribe a luggage handle. The handle mate including a retaining mechanism configured to retain the luggage handle nested in the arc.

20 Claims, 5 Drawing Sheets

(56) References Cited

U.S. PATENT DOCUMENTS

| | | | | |
|---|---|---|---|---|
| 6,948,601 | B1 * | 9/2005 | Fisher | A45C 13/262 16/113.1 |
| 7,168,537 | B2 * | 1/2007 | Bellini | A45C 13/262 16/113.1 |
| 8,381,358 | B1 * | 2/2013 | Frey | A45F 5/10 16/406 |
| 2011/0173778 | A1 * | 7/2011 | Wales | B25G 3/20 16/426 |
| 2014/0259533 | A1 * | 9/2014 | Day | B25G 3/20 16/426 |
| 2017/0106525 | A1 * | 4/2017 | Brauer | B25F 5/026 |

* cited by examiner

AUXILIARY HANDLE AND METHOD

CROSS-REFERENCE TO RELATED APPLICATION

This application relates and claims priority to U.S. Provisional Patent Application No. 62/586,820 filed Nov. 15, 2017, the disclosure of which this document incorporates by reference in its entirety.

BACKGROUND OF THE INVENTION

The following includes information that may be useful in understanding this disclosure. It is not an admission that any of the provided information is prior art nor material to the now described or claimed inventions, nor that any publication or document that is specifically or implicitly referenced is prior art.

1. FIELD OF THE INVENTION

This invention is about baggage accessories and specifically about baggage handles.

2. DESCRIPTION OF RELATED ART

Travel containers may be cumbersome to pull and push while traveling. Conventional luggage or baggage includes wheels and a handle for allowing a user to maneuver their belongings. But the handle integrated with conventional luggage is stationary, rigid, and offers little freedom when gripping. These handle restrictions may fatigue and discomfort some users when they transport their bags. Past work has presented various handle designs and shapes as solutions to address this problem.

U.S. Pat. No. 6,578,231, to Donald E. Godshaw, relates to a luggage handle. The described luggage handle includes a luggage handle in the form of a closed, equilateral triangle, molded plastic loop includes latch members attached to an apex of the loop. The latch members join the ends of an adjustable length, flexible flat strap.

BRIEF SUMMARY OF THE INVENTION

In view of disadvantages innate in the known baggage accessory art, this document discloses a novel handle and method.

A handle is disclosed. In some versions, the handle includes a handgrip with a top portion, a bottom portion, and opposing side portions. The portions form a structure with or without an opening. A ball joint connects in series to the bottom portion of the handgrip and may include a spheroid member and a socket member. The spheroid member nests in the socket member. A hinge joint connects in series to the ball joint and the bottom portion. The hinge joint may include a connection axis and may have a first armature and a second armature. The first and second armatures pivot about the connection axis. A handle mate connects in series to the bottom portion of the handgrip, the ball joint, and the hinge joint. The handle mate may have an arc partially surrounding a luggage handle. The handle mate may include a retaining mechanism that keeps the luggage handle nested in the arc.

A method of using the handle is also disclosed. The method of using the handle may comprise the steps of providing a handle as discussed above. A step of attaching the handle mate to the luggage handle. A step of retaining the handle mate on the luggage handle with the retaining mechanism. Optional method steps for using the handle include a step of locking the ball joint, a step of locking the hinge joint, and a step of pulling luggage with the handle attached to the luggage handle.

For purposes of summarizing the invention, this document describes certain aspects, advantages, and novel features of the invention. Not all such advantages may be achieved by a particular invention example. Thus, the manner of carrying out or embodying the invention may achieve or optimize one or more advantages without necessarily achieving other disclosed advantages. The features of the invention that are believed to be novel are particularly pointed out and distinctly claimed in the concluding portion of the specification. These and other features, aspects, and advantages of this invention will become better understood by referencing the following drawings and detailed description.

BRIEF DESCRIPTION OF THE DRAWINGS

The figures that go with this specification show embodiments and methods of use include an auxiliary handle and method, made and working as taught.

The various embodiments of this invention will be described in conjunction with the appended drawings, wherein like designations denote like elements.

DETAILED DESCRIPTION

As discussed above, embodiments of this disclosure relate to a baggage accessory and more particularly to a handle and method as used to improve the handle.

Generally, the handle is an easily attachable, external handle for luggage. The handle comprises a handgrip, a ball joint, a hinge joint, and a handle mate connected in series. The handgrip may have a shape that a user can easily grip. Gripping shapes may include any solid or hollow shape having any number of openings configured to ergonomically fit the user's hand. The handgrip may further include traction sheathing made of rubber. The ball joint and the hinge joint may provide easy rotation and maneuverability. Alternatively, the ball joint and the hinge joint may be configured to independently lock in position. These locking features allow for customizing the handle shape. Further, the ball joint and the hinge joint may be removable and interchangeable, allowing for additional customization. The handle mate portion can attach to any conventional luggage handle.

Figure 1:
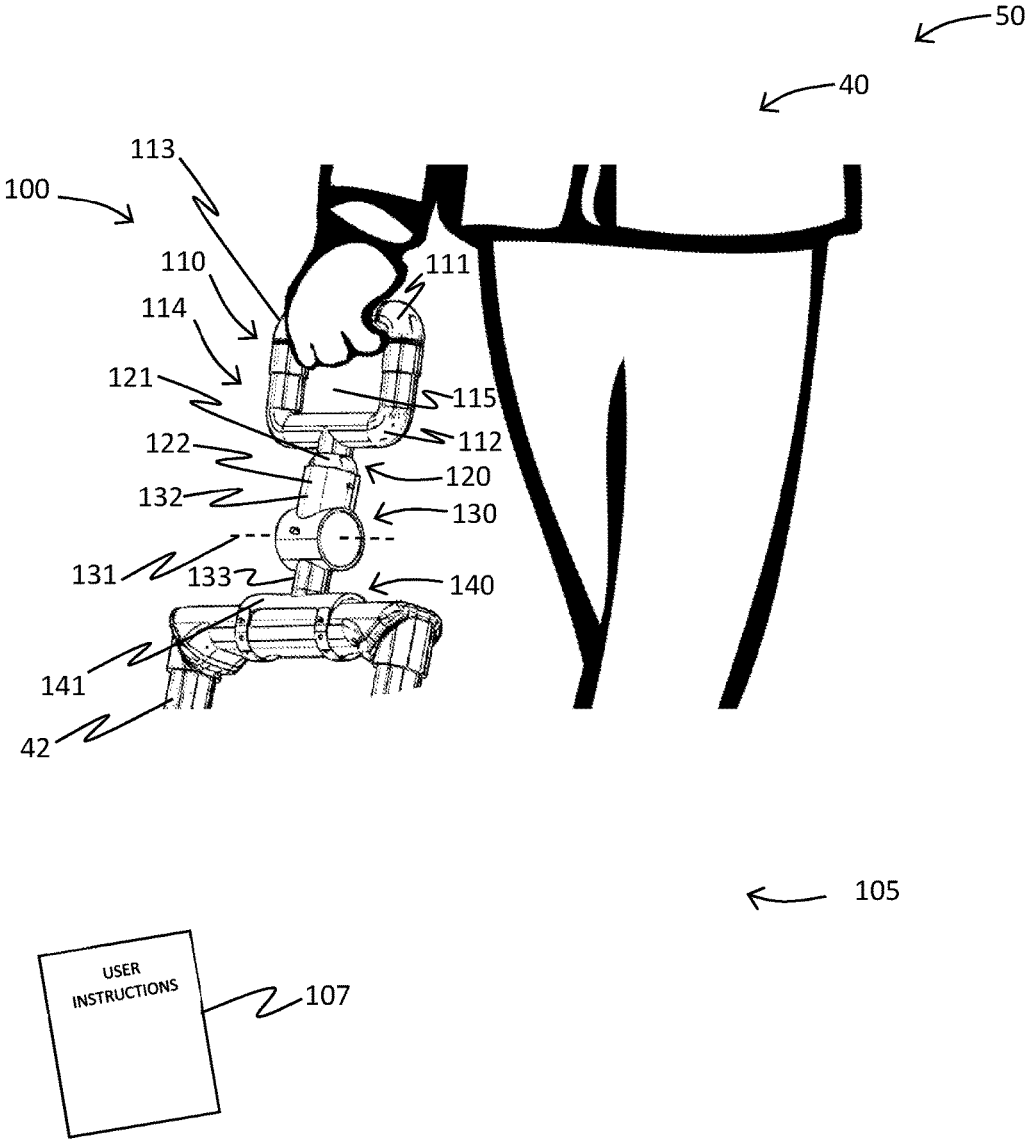
FIG. 1 is a perspective view of the handle during an 'in-use' condition, according to an embodiment of the disclosure.

Referring now more specifically to the drawings by reference numerals, FIGS. 1-4 depict various views of a handle 100. FIG. 1 shows a handle 100 during an 'in-use' condition 50 by a user 40, in line with an embodiment of this disclosure. As illustrated, the handle 100 may include a handgrip 110, a ball joint 120, a hinge joint 130, and a handle mate 140. The handgrip 110 may have a top portion 111, a bottom portion 112, and opposing side portions 113. The portions are joined to form a structure 114 that may have an opening 115. That is, the structure 114 may be an open structure. The ball joint 120 is connected in series to the bottom portion 112. The ball joint 120 includes a spheroid member 121 and a socket member 122. The spheroid member 121 may be nested in the socket member 122. The hinge joint 130 is connected in series to the ball joint 120 and the bottom portion 112. The hinge joint 130 may include a connection axis 131. The hinge joint 130 may have a first armature 132 and a second armature 133. In some versions, the first armature 132 may have the same structure as the socket member 122. The first armature 132 and the second armature 133 can pivot about the connection axis 131. The bottom portion 112, the ball joint 120 and the hinge joint 130 connected in series to the handle mate 140. The handle mate 140 may connect to a luggage handle 42 using an arc 141 to wrap or wrap partially the luggage handle 42. The handle mate 140 may include a retaining mechanism attachable to the luggage handle 42. In some versions, the retaining mechanism attachable to the luggage handle 42 nests in the arc 141.

According to one embodiment, the handle 100 and a set of instructions 107 may be arranged as a kit 105. The instructions 107 may detail functional relationships of the structure of the handle 100 (such as how the handle 100 can be used, maintained, or the like, in a preferred manner).

Figure 2:
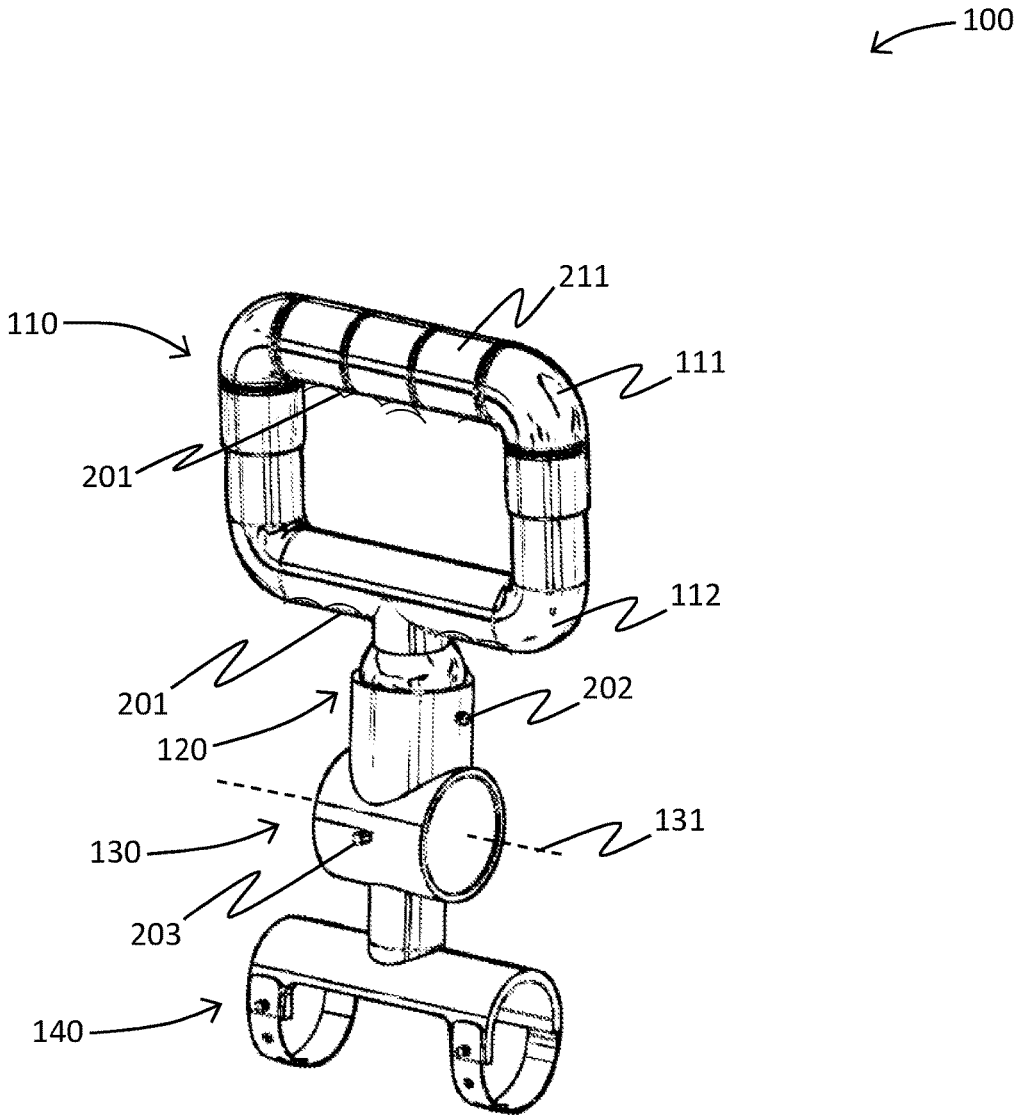
FIG. 2 is a perspective view of the handle of FIG. 1, according to an embodiment of this disclosure.

FIG. 2 shows a perspective view of the handle 100 of FIG. 1, according to an embodiment of this disclosure. As above, the handle 100 may include a handgrip 110, a ball joint 120, a hinge joint 130, and a handle mate 140. The top portion 111 includes a rubber sleeve 211. The top portion 111 may include anatomical grooves 201 to fit a user's hand. The bottom portion 112 may also include the grooves 201. The ball joint 120 may include a ball-locking mechanism 202, which may inhibit the spheroid member 121 rotation (FIG. 1) within the socket member 122 (FIG. 1). The hinge joint 130 may include a hinge-locking mechanism 203 that may be configured to inhibit rotation of the first armature 132 (FIG. 1) and the second armature 133 (FIG. 1) about the connection axis 131.

Figure 3:
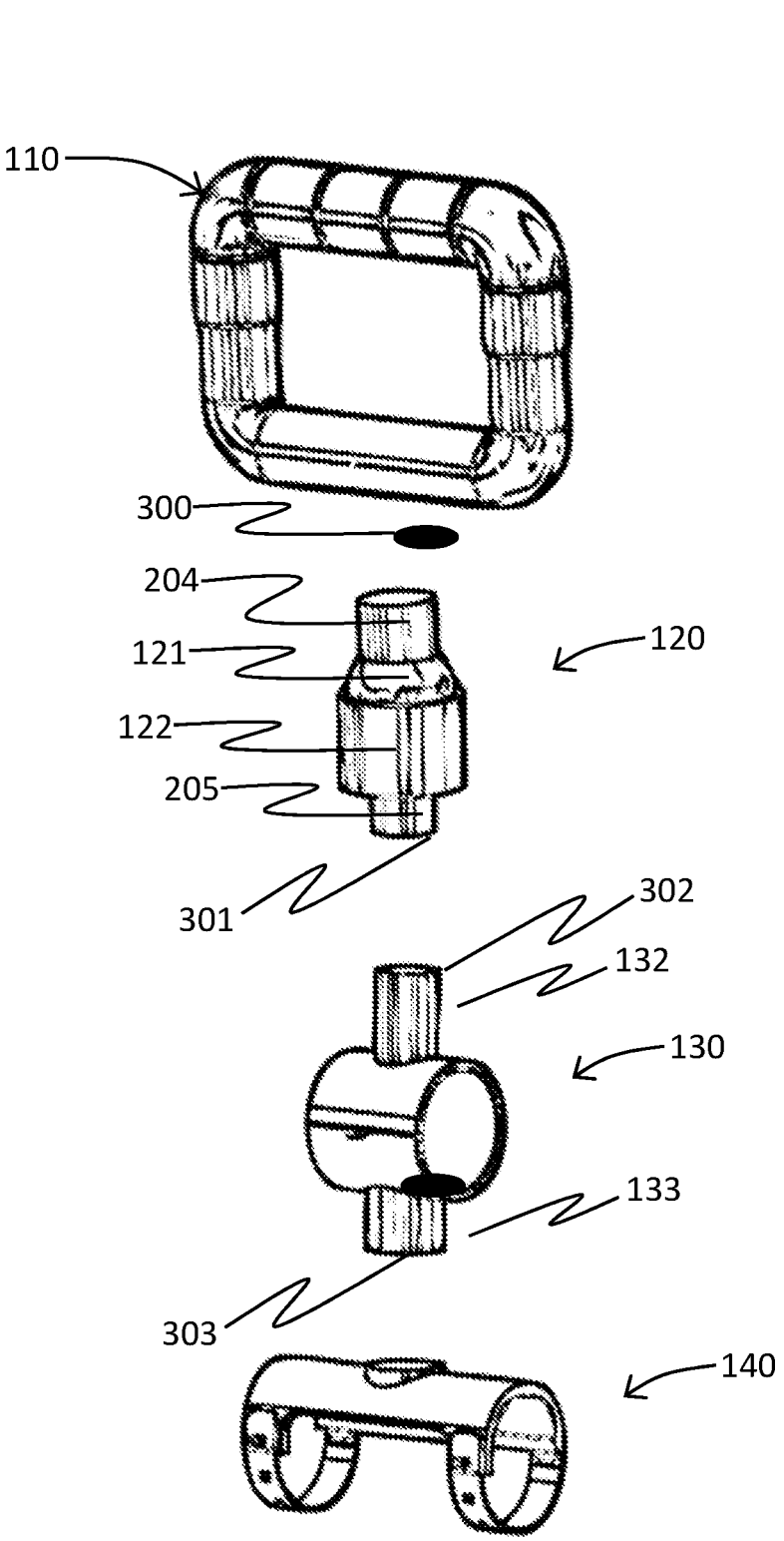
FIG. 3 is a partially exploded view of the handle of FIG. 1, according to an embodiment of this disclosure.

FIG. 3 shows a partially exploded view of the handle 100 of FIG. 1. As above, the handle 100 may include a handgrip 110, a ball joint 120, a hinge joint 130, and a handle mate 140. The spheroid member 121 includes a spheroid armature 204. The spheroid armature 204 may include a spheroid attachment 300. The socket member 122 includes a socket armature 205. The socket armature 205 may include a socket attachment 301. The first armature 132 of the hinge joint 130 may include a first attachment 302. The second armature 133 of the hinge joint 130 may include a second attachment 303. The spheroid attachment 300, the socket attachment 301, the first attachment 302, and the second attachment 303 may be configured to interchangeably connect. At least one of the spheroid armature 204, the socket armature 205, the first armature 132, and the second armature 133 may have telescopic functionality. In some versions, telescopic functionality includes a lock to secure the telescoping pieces with respect to one another other.

Figure 4:
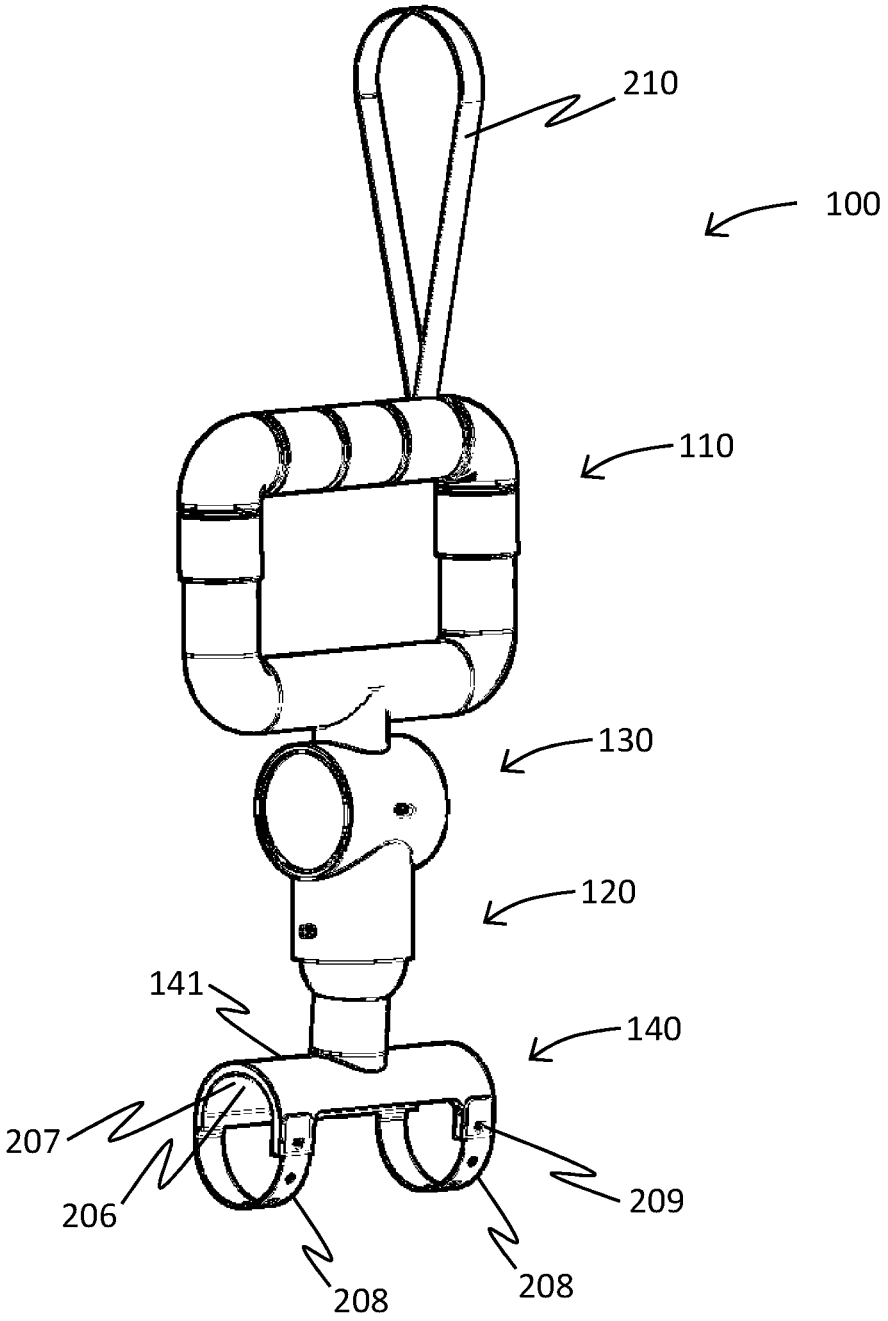
FIG. 4 is a perspective view of the handle of FIG. 1, according to an embodiment of this disclosure.

FIG. 4 shows a perspective view of the handle 100 of FIG. 1, according to an embodiment of this disclosure. As above, the handle 100 may include a handgrip 110, a ball joint 120, a hinge joint 130, and a handle mate 140. The handle mate 140 may clamp to luggage handle 42 (FIG. 1). The arc 141 of the handle mate 140 may include an arc interior 206 that may have a traction material 207. The retaining mechanism may include straps 208, which may be configured to attach to a fastening structure 209. The handle may further include a wrist strap 210.

Figure 5:
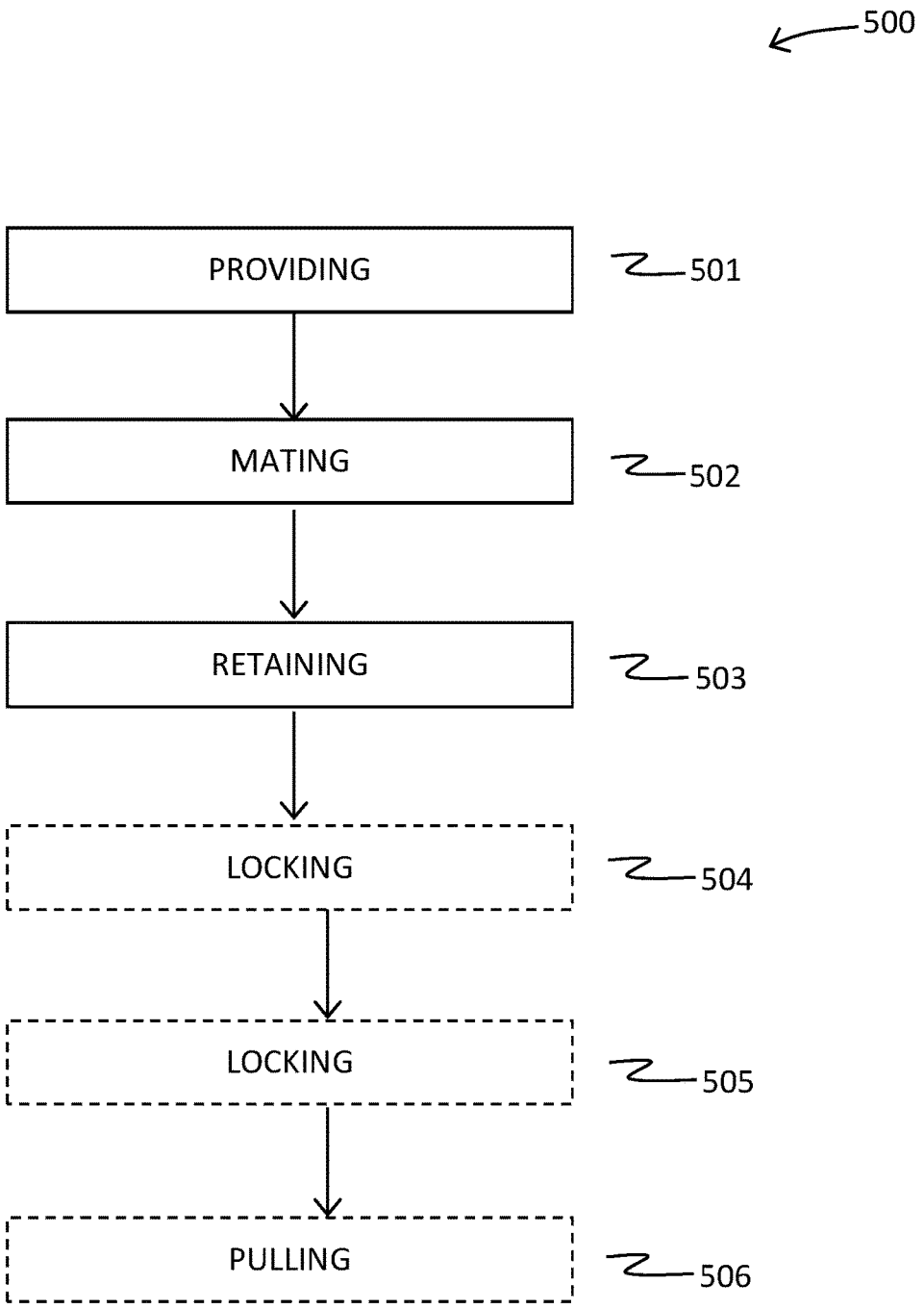
FIG. 5 is a flow diagram illustrating a method of use for the handle, according to an embodiment of this disclosure.

FIG. 5 is a flow diagram 550 illustrating a method of use of the handle 500, according to an embodiment of this disclosure. As illustrated, the method of using the handle 500 may include the steps of providing 501 a handle 100, such as the various handles described above; attaching 502 the handle mate 140 to the luggage handle 42; retaining 503 the handle mate 140 on the luggage handle 42 with the retaining mechanism; locking 504 the ball joint 120; locking 505 the hinge joint 130; and pulling 506 the luggage with the handle.

It should be noted that steps 504, 505, and 506 are optional steps and not all versions implement them. Optional steps of the method of use 500 are illustrated using dotted lines in FIG. 5 to distinguish them from the other method steps. The method-of-use steps can happen in many different orders according to user preference. The use of "step of" should not be interpreted as "step for" in the claims and is not intended to invoke the provisions of 35 U.S.C. § 112(f). Under appropriate circumstances, considering such issues as design preference, user preferences, marketing preferences, cost, structural requirements, available materials, technological advances, etc., other methods for the handle 100 (e.g., different step orders within above-mentioned list, elimination or addition of certain steps, including or excluding certain maintenance steps, etc.), are taught.

The embodiments of the invention described are exemplary and numerous modifications, variations, and rearrangements can be readily envisioned to achieve substantially equivalent results, all of which are intended to fall within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A handle comprising:

a handgrip having a top portion, a bottom portion, and opposing side portions wherein the portions form an open structure;

a ball joint that connects in series to the bottom portion and includes a spheroid member and a socket member, wherein the spheroid member nests in the socket member;

a hinge joint that connects in series to the ball joint and the bottom portion, and includes a connection axis having a first armature and a second armature, wherein the first armature and the second armature can pivot about the connection axis;

and a handle mate that connects in series to the bottom portion, the ball joint, and the hinge joint, and includes an arc and a retaining mechanism which can keep a luggage handle connected to the handle mate.

2. The handle of claim 1 wherein the top portion includes a rubber sleeve.

3. The handle of claim 1 wherein the top portion includes anatomical grooves configured to fit a user's hand.

4. The handle of claim 1 wherein the bottom portion includes anatomical grooves configured to fit a user's hand.

5. The handle of claim 1 wherein the ball joint includes a ball-locking mechanism, configured to inhibit rotation of the spheroid member within the socket member.

6. The handle of claim 1 wherein the hinge joint includes a hinge-locking mechanism, configured to inhibit rotation of the first armature and the second armature about the connection axis.

7. The handle of claim 1 wherein the spheroid member includes a spheroid armature with a spheroid attachment.

8. The handle of claim 7 wherein the socket member includes a socket armature with a socket attachment.

9. The handle of claim 8 wherein the first armature includes a first attachment.

10. The handle of claim 9 wherein the second armature includes a second attachment.

11. The handle of claim 10 wherein the spheroid attachment, the socket attachment, the first attachment, and the second attachment interchangeably connect.

12. The handle of claim 11 wherein at least one of the spheroid armature, the socket armature, the first armature, and the second armature has telescopic functionality.

13. The handle of claim 1 wherein the handle mate is configured to clamp to the luggage handle.

14. The handle of claim 1 wherein the arc includes an arc interior having a traction material.

15. The handle of claim 1 wherein the retaining mechanism includes straps configured to attach to a fastening structure.

16. The handle of claim 1 wherein the handle further includes a wrist strap.

17. A handle comprising:

a handgrip having a top portion, a bottom portion, and opposing side portions wherein the portions form an open structure;

a ball joint that connects in series to the bottom portion and includes a spheroid member and a socket member, wherein the spheroid member nests in the socket member;

a hinge joint connects in series to the ball joint and the bottom portion and includes a connection axis having a first armature and a second armature, wherein the first armature and the second armature are which can pivot about the connection axis;

and a handle mate that connects in series to the bottom portion, the ball joint, and the hinge joint, and includes an arc and a retaining mechanism which can keep a luggage handle connected to the handle mate;

wherein the top portion includes a rubber sleeve and anatomical grooves configured to fit a user's hand, the ball joint includes a ball-locking mechanism configured to inhibit rotation of the spheroid member within the socket member, the hinge joint includes a hinge-locking mechanism configured to inhibit rotation of the first armature and the second armature about the connection axis, the spheroid member includes a spheroid armature with a spheroid attachment, the socket member includes a socket armature with a socket attachment;

the first armature includes a first attachment;

the second armature includes a second attachment;

the spheroid attachment, the socket attachment, the first attachment, and the second attachment interchangeably connect, at least one of the spheroid armature, the socket armature, the first armature, and the second armature has telescopic functionality, the handle mate is configured to clamp to the luggage handle, the arc of the handle mate includes an arc interior having a traction material, the retaining mechanism includes straps configured to attach to a fastening structure, and the handle further includes a wrist strap.

18. The handle of claim 17 further comprising a set of instructions and wherein the instructions and the handle are arranged as a kit.

19. A method of using a handle comprising the steps of:

providing a handle having a handgrip with a top portion, a bottom portion, and opposing side portions wherein the portions form an open structure;

a ball joint that connects in series to the bottom portion and includes a spheroid member and a socket member, wherein the spheroid member nests in the socket member;

a hinge joint that connects in series to the ball joint and the bottom portion and includes a connection axis having a first armature and a second armature, wherein the first armature and the second armature can pivot about the connection axis;

and a handle mate that connects in series to the bottom portion, the ball joint, and the hinge joint and includes an arc and a retaining mechanism configured to keep a luggage handle nested in the arc;

attaching the handle mate to the luggage handle;

and retaining the handle mate on the luggage handle with the retaining mechanism.

20. The method of claim 19 further comprising the steps of locking the ball joint;

locking the hinge joint;

and pulling luggage with the handle.

* * * * *